US005708237A

United States Patent [19]

Maeda et al.

[11] Patent Number: 5,708,237

[45] Date of Patent: Jan. 13, 1998

[54] AUTOMOBILE EXHAUST NOISE SILENCER

[75] Inventors: Kazushige Maeda, Yokohama; Akira Sasaki; Takao Kubozuka, both of Yokosuka, all of Japan

[73] Assignee: Nissan Motor Co., Ltd., Kanagawa, Japan

[21] Appl. No.: 813,948

[22] Filed: Mar. 3, 1997

[30] Foreign Application Priority Data

Mar. 6, 1996 [JP] Japan ..... 8-49092

[51] Int. Cl.[6] ..... F01N 1/00

[52] U.S. Cl. ..... 181/254; 181/265; 181/272

[58] Field of Search ..... 181/237, 254, 181/265, 266, 272, 282, 256

[56] References Cited

U.S. PATENT DOCUMENTS

| | | | |
|---|---|---|---|
| 4,484,659 | 11/1984 | Buchwalder | 181/272 X |
| 4,971,166 | 11/1990 | Hase | 181/254 |
| 5,614,699 | 3/1997 | Yashiro et al. | 181/254 |

FOREIGN PATENT DOCUMENTS 7-107452 4/1995 Japan .

*Primary Examiner*—Khanh Dang

*Attorney, Agent, or Firm*—Lowe, Price, LeBlanc & Becker

[57] ABSTRACT

An inlet tube leads exhaust gas from an automobile engine to an expansion chamber inside a muffler housing. Exhaust gas from the expansion chamber is discharged to the atmosphere via a first tail tube. A dead space chamber and volume chamber are disposed on either side of the expansion chamber in the housing, and a first internal tube connects the volume chamber and expansion chamber. A second internal tube having a valve which opens under pressure of the exhaust gas connects the volume chamber and dead space chamber. Exhaust gas from the dead space chamber is discharged to the atmosphere via a second tail tube. As the dead space chamber and volume chamber are not adjacent, pressure waves in the volume chamber do not cause a volume change of the dead space chamber, and emission noise from the second tail tube due to excitation of a resonance system comprising the dead space chamber, is reduced.

5 Claims, 3 Drawing Sheets

AUTOMOBILE EXHAUST NOISE SILENCER

FIELD OF THE INVENTION

This invention relates to an exhaust noise silencer for an automobile.

BACKGROUND OF THE INVENTION

An engine exhaust noise silencer for an automobile wherein an exhaust passage is changed over by a valve in response to an exhaust pressure is disclosed for example in WO 95/13460 published by WIPO in 1995 and Tokkai Hei7-107452 published by the Japanese Patent Office in 1995. The noise silencer in the former reference comprises a plurality of exhaust passages in a muffler, a valve responsive to the exhaust pressure being provided in one of these passages. This silencer has, however, only one tail tube which discharges the exhaust gas in the muffler to the atmosphere and therefore the exhaust noise increases as the engine rotation becomes higher.

The noise silencer in the latter reference has two tail tubes 108 and 113 as shown in FIG. 6. In this silencer, the interior of a muffler shell 101 is divided into three muffle chambers separated by baffle plates 105, 106, i.e., into an expansion chamber 103, dead space chamber 102 and volume chamber 104. Exhaust is introduced into the expansion chamber 103 through an inlet tube 107.

The expansion chamber 103 is connected to the volume chamber 104 through a neck tube 110, and connected to the atmosphere through the first tail tube 108. The dead space chamber 102 is connected to the atmosphere through the second tail tube 113. An opening is formed in the baffle plate 106 which separates the dead space chamber 102 and volume chamber 104, and an exhaust pressure response valve 112 which opens according to an exhaust pressure is provided in this opening.

The exhaust pressure response valve 112 closes when the exhaust pressure is low such as at low engine rotation speed, and the volume chamber 104 and expansion chamber 103 are then connected only via the neck tube 110. In this case, the volume chamber 104 functions as a resonance element, and effectively reduces low frequency exhaust noise.

When the exhaust pressure rises due to increase of engine speed and the exhaust pressure response valve 112 opens, part of the exhaust gas introduced into the expansion chamber 103 passes via the volume chamber 104, and is discharged from the dead space chamber 102 through the second tail tube 113 to the atmosphere. The volume chamber 104 then functions as an expansion element so that high frequency exhaust noise is reduced, exhaust pressure loss is reduced and engine output is enhanced.

Noise dampers 109 and 114 are provided in the first tail tube 108 and second tail tube 113. These dampers 109, 114 cover the numerous small holes formed in the tail tubes with a sound absorbing material, and thereby reduce noise of the exhaust gas in the tail tubes 104, 113. The sound absorbing material is further sheathed in an outer tube so that exhaust gas does not leak from the tail tubes 108, 113 into the dead space chamber 102, expansion chamber 103 and volume chamber 104.

However in this exhaust noise silencer, under running conditions when the exhaust pressure response valve 112 is closed, pressure oscillations in the volume chamber 104 set up a resonance system with the dead space chamber 102 acting as a spring and the second tail tube 113 acting as a mass so that the second tail tube which is open to the atmosphere emits noise. In other words, when the exhaust pressure response valve 112 is closed, and the volume chamber 104 acts as resonance element in a specified frequency region determined by the volume chamber 104 and neck tube 110, pressure waves in the volume chamber 104 are at a maximum. Due to this pressure fluctuation, the baffle plate 106 which separates the volume chamber 104 and dead space chamber 102 suffers a vibration of a membrane. Volume fluctuations of the dead space chamber 102 also increase due to this vibration of a membrane, the resonance system comprising the dead space chamber 102 and second tail tube 113 is excited, and the second tall tube 113 emits a large noise.

SUMMARY OF THE INVENTION

It is therefore an object of this invention to reduce a vibration transmitted to a dead space chamber from a volume chamber when the volume chamber functions as a resonance element.

It is a further object of this invention to reduce noise emission in a tail tube.

In order to achieve the above objects, this invention provides an exhaust noise silencer for attenuating exhaust gas noise of an automobile engine. This exhaust noise silencer comprises a housing, an expansion chamber formed inside the housing, an inlet tube for leading exhaust gas to the expansion chamber, a first tail tube for discharging exhaust gas from the expansion chamber to the atmosphere, a dead space chamber formed inside the housing, a second tail tube for discharging exhaust gas from the dead space chamber to the atmosphere, a volume chamber formed inside the housing, the expansion chamber being formed between the volume chamber and the dead space chamber, a first internal tube connecting the volume chamber and expansion chamber, a second internal tube connecting the volume chamber and dead space chamber through the expansion chamber, and a valve which opens and allows exhaust gas to flow from the volume chamber to the dead space chamber via the second internal tube when the pressure of the volume chamber is greater than a predetermined value.

It is preferable that the inlet tube passes through the volume chamber, the volume chamber and the dead space chamber being disposed such that the flow directions of exhaust gas of the second internal tube and the inlet tube are the same.

It is also preferable that the volume chamber is formed by a baffle plate having an opening, and the second internal tube passes through the opening with a predetermined clearance.

In this case, it is further preferable that the silencer further comprises a pipe fixed to the opening of the baffle board so that the pipe passes though the opening, and that the second internal tube passes through this pipe with a predetermined clearance.

This invention also provides an exhaust noise silencer comprising a housing, an expansion chamber formed inside the housing, an inlet tube for leading exhaust gas to the expansion chamber, a first tail tube for discharging exhaust gas from the expansion chamber to the atmosphere, a dead space chamber formed inside the housing, a second tail tube for discharging exhaust gas from the dead space chamber to the atmosphere, a volume chamber formed inside the housing, a first internal tube connecting the volume chamber and the expansion chamber, a second internal tube connecting the volume chamber and the dead space chamber, a valve which allows exhaust gas to flow from the volume chamber to the dead space chamber via the second internal tube when the pressure of the volume chamber is greater than a predetermined value, and an air chamber connected to the atmosphere which is disposed between the volume chamber and the dead space chamber.

The details as well as other features and advantages of this invention are set forth in the remainder of the specification and are shown in the accompanying drawings.

DESCRIPTION OF THE PREFERRED EMBODIMENTS

Figure 1:
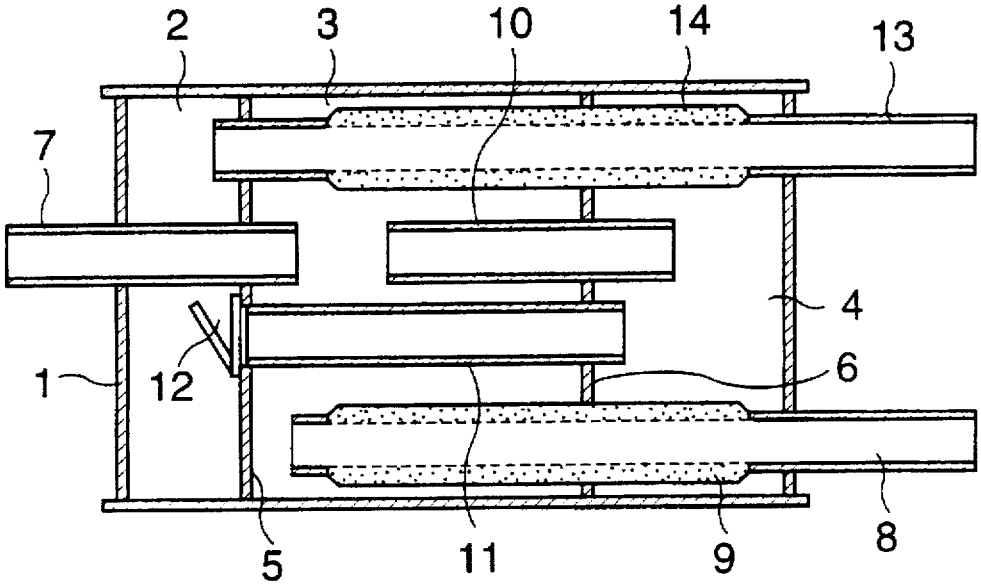
FIG. 1 is a sectional view of a noise silencer according to a first embodiment of this invention.

Referring to FIG. 1 of the drawings, a housing 1 comprises three muffle chambers separated by baffle plates 5, 6, i.e. a dead space chamber 2, expansion chamber 3 and volume chamber 4.

Exhaust from an engine, not shown, is introduced into the middle expansion chamber 3 through an inlet tube 7. The expansion chamber 3 is connected to the volume chamber 4 via a neck tube 10, and also to the atmosphere via a first tail tube 8. This neck tube 10 constitutes a first internal tube. The dead space chamber 2 is connected to the atmosphere by a second tail tube 13, and also to the volume chamber 4 via a pass tube 11 which passes through the expansion chamber 3. This pass tube 11 constitutes a second internal tube. An exhaust pressure response valve 12 is provided in an opening of the pass tube formed in the baffle plate 5 leading to the dead space chamber 2. When this exhaust pressure response valve 12 opens, exhaust gas is introduced into the dead space chamber 2 from the volume chamber 4, and the dead space chamber 2 is isolated when the exhaust pressure response valve 12 closes.

When exhaust pressure is low such as in the low engine rotation speed region, the exhaust pressure response valve 12 is closed by the force of springs, not shown.

In this state, the expansion chamber 3 and volume chamber 4 which are connected only via the neck tube 10 function as resonance elements, and low frequency exhaust noise is reduced.

On the other hand when the exhaust pressure exceeds a fixed value due to increase of engine rotation speed, the exhaust pressure response valve 12 opens.

In this state, a part of the exhaust gas introduced into the expansion chamber 3 is discharged to the atmosphere via the first tail tube 8, but the residual gas is led to the dead space chamber 2 via the pass tube 11 and is discharged to the atmosphere via the second tail inner tube 13. This causes the volume chamber 4 to function not as a resonance element but as an expansion element, thereby reducing high frequency exhaust noise, reducing exhaust pressure losses and contributing to improvement of engine output.

In addition to the above, noise dampers 9 and 14 are provided in the first tail tube 8 and second tail tube 13. These noise dampers have the same construction as those of the prior art.

In this exhaust noise silencer also, when the exhaust pressure response valve 12 is closed such as in the low engine rotation speed region, the volume chamber 4 and expansion chamber 3, which are connected only via the neck tube 10, attenuate relatively low frequency exhaust noise by a resonance effect of the chamber 4.

According to this resonance effect, pressure waves in the volume chamber 4 fluctuate heavily, so the baffle plate 6 which separates the volume chamber 4 suffers a vibration of a membrane.

However as the expansion chamber 3 is situated between the volume chamber 4 and dead space chamber 2, the volume chamber 4 and dead space chamber 2 are connected only by the pass tube 11 which passes through the expansion chamber 3. Accordingly the vibration of a membrane of the baffle plate 6 does not cause a volume change of the dead space chamber 2, and the vibration of a membrane of the baffle plate 6 is transmitted to the baffle plate 5 only via the pass tube 11. Since there is no volume change in the dead space chamber 2, even if it does set up a resonance system comprising the dead space chamber 2 acting as a spring and the second tail tube 13 acting as a mass, the noise emitted by the tail tube 13 is minimal.

Figure 2:
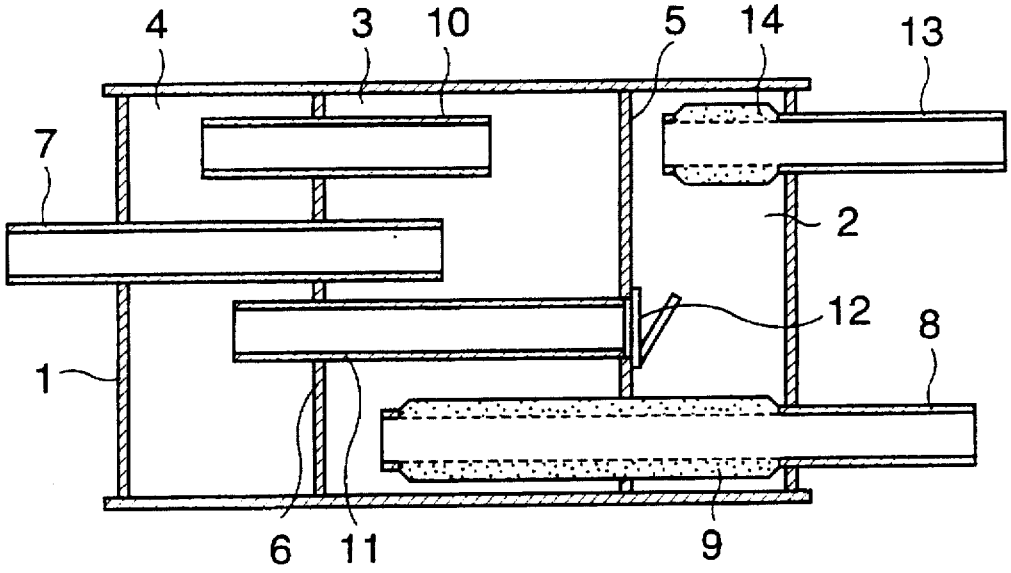
FIG. 2 is a sectional view of a noise silencer according to a second embodiment of this invention.

FIG. 2 shows a second embodiment of this invention. According to this embodiment, the relative position of the dead space chamber 2 to the volume chamber 4 in the aforesaid first embodiment shown in FIG. 1 is reversed. In this case, the volume chamber 4 is provided on the side of the inlet tube, and the dead space chamber 2 is provided on the side of the first tail tube 8 and second tail tube 13.

The volume chamber 4 and dead space chamber 2 are connected by the pass tube 11. According also to this embodiment, the volume chamber 4 and dead space chamber 2 are not adjacent to each other, so that resonance system noise caused by the vibration of a membrane of the baffle plate 6 is greatly reduced.

According to this embodiment, unlike the first embodiment, the second tail tube 13 does not pass through either the expansion chamber 3 or volume chamber 4, so transmission of vibration from the volume chamber 4 to the dead space chamber 2 is further reduced.

Figure 3:
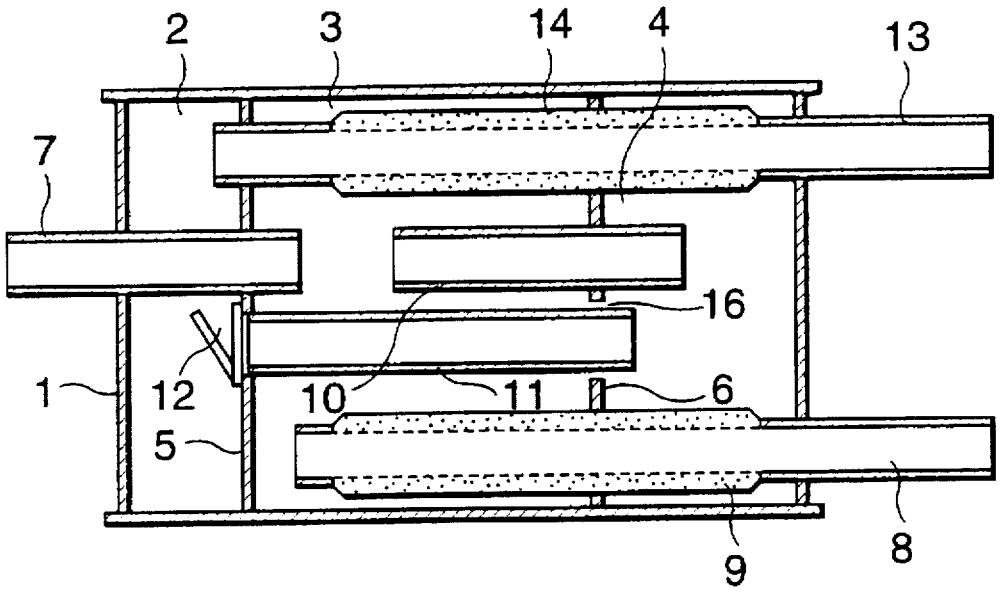
FIG. 3 is a sectional view of a noise silencer according to a third embodiment of this invention.

FIG. 3 shows a third embodiment of this invention. This embodiment is similar to the first embodiment. However an opening 16 is further provided in the baffle plate 6, and one end of the pass tube 11 is inserted into this opening 16 with a predetermined clearance. Therefore, unlike the first embodiment, the baffle plate 6 and pass tube 11 are not rigidly joined together.

Due to this arrangement, the pass tube 11 is effectively isolated from the baffle plate 6 and free from the vibration thereof, even if the baffle plate 6 of the volume chamber 4 suffers the vibration of a membrane. Consequently a volume change of the dead space chamber 2 does not occur and noise emission from the second tail tube 13 is further reduced.

Figure 4:
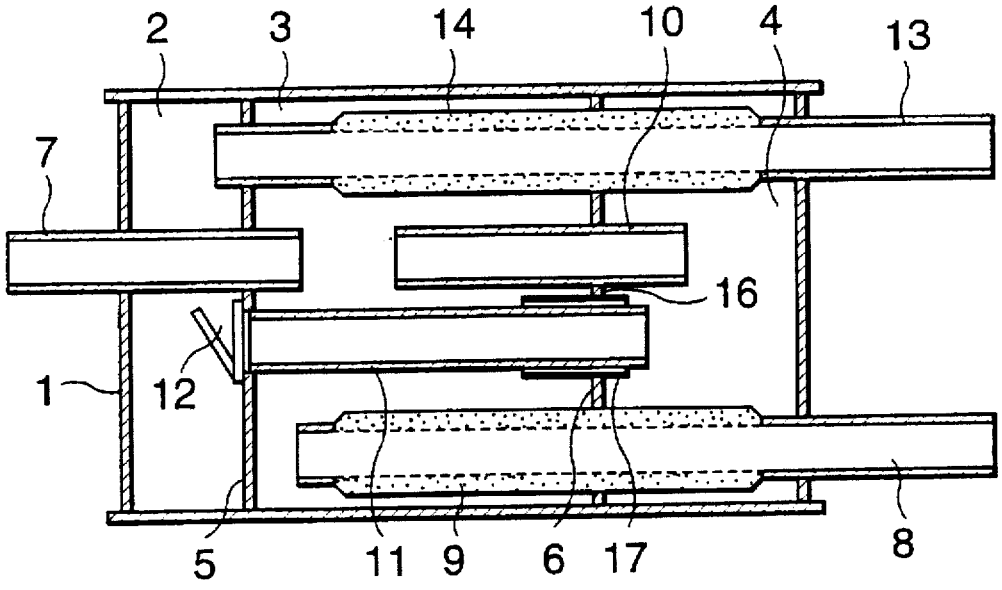
FIG. 4 is a sectional view of a noise silencer according to a fourth embodiment of this invention.

FIG. 4 shows a fourth embodiment of this invention. In this noise silencer, a pipe 17 is fixed to the opening of the baffle plate 6, and the pass tube 11 is set to pass through the pipe 17 with a predetermined clearance. As the pipe 17 connects the expansion chamber 3 and volume chamber 4, the pipe 17 functions as a neck tube of a resonance system the characteristics of which are determined by the cross-sectional area obtained by subtracting the cross-sectional area of the tube 11 from that of the pipe 17, and its length in the axial direction. This works together with the neck tube 10 so as to improve low frequency noise damping characteristics when the exhaust pressure response valve 12 is closed. According also to this embodiment, the vibration of a membrane of the baffle plate 6 is not transmitted to the pass tube 11, hence as in the case of the third embodiment, volume change of the dead space chamber 2 is prevented and emission of noise from the second tail tube 13 is reduced.

Figure 5:
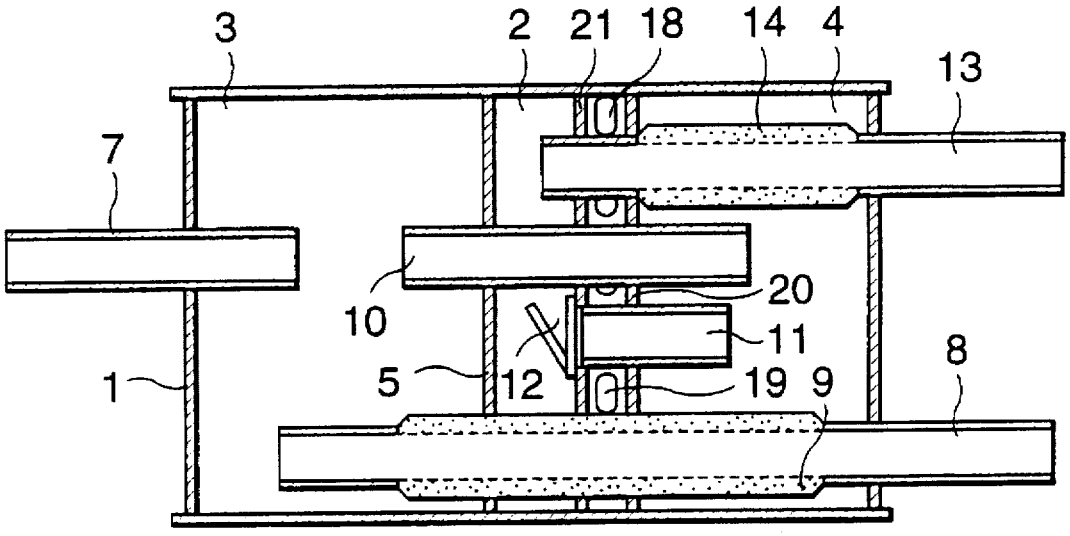
FIG. 5 is a sectional view of a noise silencer according to a fifth embodiment of this invention.
Figure 6:
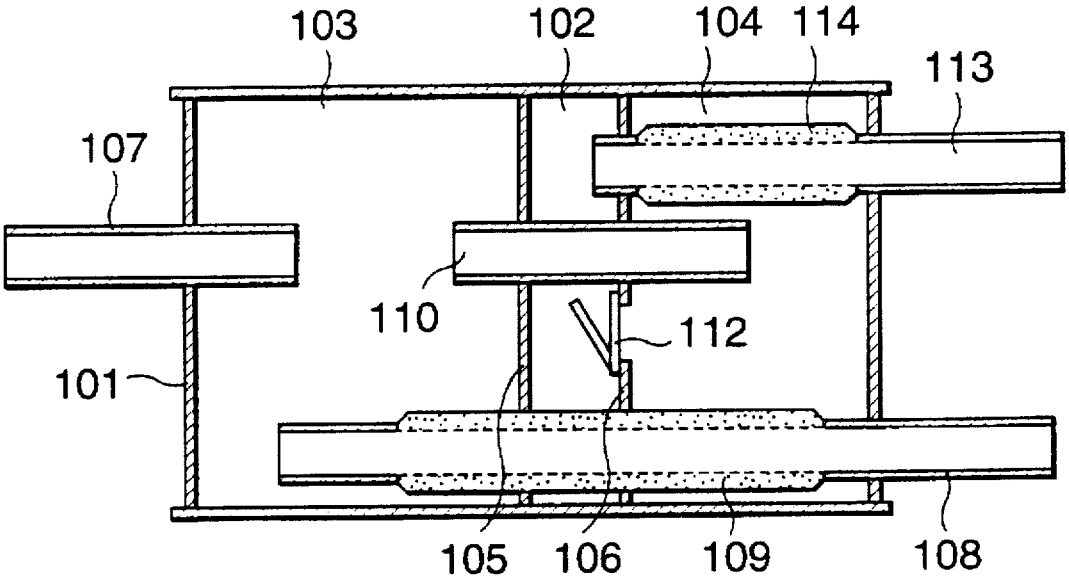
PRIOR ART FIG.6
FIG. 6 is a sectional view of a conventional noise silencer.

FIG. 5 shows a fifth embodiment of this invention.

According to this embodiment, an air chamber 18 is formed instead of the expansion chamber 3 between the volume chamber 4 and dead space chamber 2. This air chamber 18 prevents the dead space chamber 2 from adding to the vibration due to pressure oscillations of the volume chamber 4.

In other words, the expansion chamber 3, dead space chamber 2 and volume chamber 4 are disposed in the housing 1 in this order from the left side in FIG. 5, and the air chamber 18 is formed between the dead space chamber 2 and volume chamber 4 by baffle plates 20, 21. The air chamber 18 is connected to the atmosphere via a passage 19.

The expansion chamber 3 and volume chamber 4 are connected together by the neck tube 10 which passes through the dead space chamber 2 and air chamber 18, and the volume chamber 4 is connected to the dead space chamber 2 via the pass tube 11.

According to this embodiment, the air chamber 18 adjacent to the baffle plate 20 is connected to the atmosphere even when the baffle plate 20 forming the volume chamber 4 suffers a vibration of a membrane due to pressure waves in the volume chamber 4, so the pressure in the air chamber 18 does not rise, and there is no increased vibration of the baffle plate 21 of the dead space chamber 2 adjacent to the air chamber 18. The vibration of the baffle plate 20 of the volume chamber 4 is therefore mainly transmitted to the baffle plate 21 of the dead space chamber 2 only through the pass tube 11. As a result, the vibration level of the baffle plate 21 is extremely low, and noise emission from the second tail tube 13 is fully reduced.

What is claimed:

1. An exhaust noise silencer for attenuating exhaust gas noise of an automobile engine, comprising:

a housing, an expansion chamber formed inside said housing, an inlet tube for leading exhaust gas to said expansion chamber, a first tail tube for discharging exhaust gas from said expansion chamber to the atmosphere, a dead space chamber formed inside said housing, a second tail tube for discharging exhaust gas from said dead space chamber to the atmosphere, a volume chamber formed inside said housing, said expansion chamber being formed between said volume chamber and said dead space chamber, a first internal tube connecting said volume chamber and expansion chamber, a second internal tube connecting said volume chamber and dead space chamber through said expansion chamber, and a valve which opens and allows exhaust gas to flow from said volume chamber to said dead space chamber via said second internal tube when the pressure of said volume chamber is greater than a predetermined value.

2. An exhaust noise silencer as defined in claim 1, wherein said inlet tube passes through said volume chamber, said volume chamber and said dead space chamber being disposed such that the flow directions of exhaust gas of said second internal tube and said inlet tube are the same.

3. An exhaust noise silencer as defined in claim 1, wherein said volume chamber is formed by a baffle plate having an opening, and said second internal tube passes through said opening with a predetermined clearance.

4. An exhaust noise silencer as defined in claim 3, further comprising a pipe fixed to said opening of said baffle plate so that said pipe passes though said opening, said second internal tube passing through said pipe with a predetermined clearance.

5. An exhaust noise silencer for attenuating exhaust gas noise of an automobile engine, comprising:

a housing, an expansion chamber formed inside said housing, an inlet tube for leading exhaust gas to said expansion chamber, a first tail tube for discharging exhaust gas from said expansion chamber to the atmosphere, a dead space chamber formed inside said housing, a second tail tube for discharging exhaust gas from said dead space chamber to the atmosphere, a volume chamber formed inside said housing, a first internal tube connecting said volume chamber and said expansion chamber, a second internal tube connecting said volume chamber and said dead space chamber, a valve which allows exhaust gas to flow from said volume chamber to said dead space chamber via said second internal tube when the pressure of said volume chamber is greater than a predetermined value, and an air chamber connected to the atmosphere which is disposed between said volume chamber and said dead space chamber.

* * * * *